United States Patent [19]

Vignon et al.

[11] Patent Number: 4,477,945

[45] Date of Patent: Oct. 23, 1984

[54] DRAWING FRAMES

[75] Inventors: Louis Vignon, Geneva; Alf Schopper, Meyrin, both of Switzerland

[73] Assignee: Heberlein Hispano SA, Vernier-Geneva, Switzerland

[21] Appl. No.: 409,292

[22] Filed: Aug. 18, 1982

[30] Foreign Application Priority Data

Aug. 24, 1981 [DE] Fed. Rep. of Germany ..... 3133438

[51] Int. Cl.[3] ..... B65H 54/80

[52] U.S. Cl. ..... 19/236; 19/159 A

[58] Field of Search ..... 19/258, 159 A, 236, 19/159

[56] References Cited

U.S. PATENT DOCUMENTS

| | | | |
|---|---|---|---|
| 3,698,041 | 10/1972 | Hertzsch | 19/159 A |
| 3,808,641 | 5/1974 | Schneider et al. | 19/159 A |
| 4,042,093 | 8/1977 | Fujii et al. | 19/159 A |
| 4,365,388 | 12/1982 | Mori et al. | 19/159 A |

*Primary Examiner*—Louis Rimrodt

*Attorney, Agent, or Firm*—Young & Thompson

[57] ABSTRACT

Slubbing, which is to be drawn, is pulled from cans (25), which are mounted behind a drawing frame. The frame comprises a double draw head section with devices for filling two cans (7 and 8), which are situated at respective filling stations. The filled cans (7 and 8) are then automatically replaced by empty cans (2): A slide (15 and 16) moves two empty cans (2) rectilinearly, counter to the working direction of the draw heads, into the filling stations and simultaneously moves the filled cans (7 and 8) rectilinearly in the same direction into two removal stations (13 and 14). Thus, the replacement of the cans (7 and 8) proceeds very rapidly and with a minimal gap between the filled cans (7 and 8) and the empty cans (2), which avoids the need for the frame to be stopped. A device (M and H) for controlling and driving the frame is accommodated in a rear part (6) of the frame housing which is situated on the side of the removal stations (13 and 14) facing the filling stations (7 and 8). The filled cans are then expelled laterally from the removal stations (13 and 14) by means of expulsion arms (17) through openings (19 and 20) on respective sides of the frame. The ground plan or working area of the drawing frame is therefore roughly rectangular and space-saving.

6 Claims, 2 Drawing Figures

DRAWING FRAMES

Figure 1:
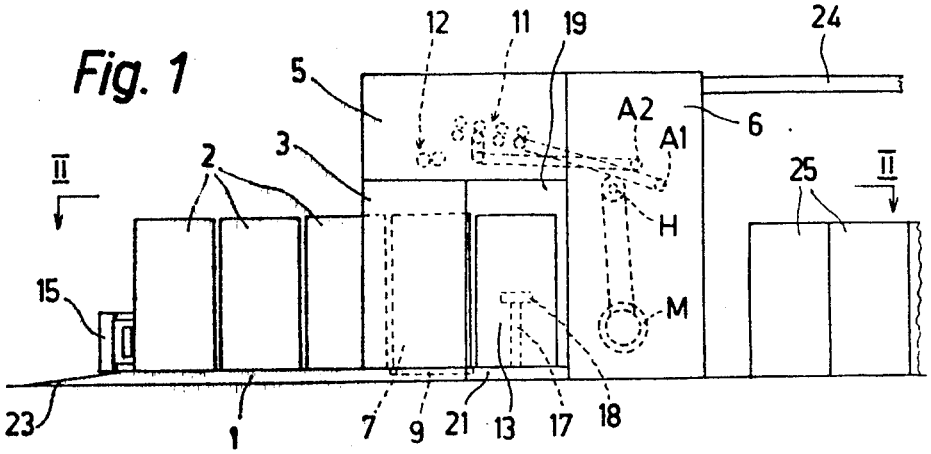

The invention relates to drawing frames, and in particular, but not exclusively, to frames with a machine frame in which is located a double draw head section with devices for filling cans at two filling stations coordinated with the two draw heads, means for the automatic replacement of filled cans by empty cans at the filling stations and a control and drive devices for the machine.

Various designs of drawing frames of this type are known. In one frame the empty cans are brought from the side onto the can plates of the filling stations and the full cans are pushed out in the working direction of the heads. Here, the empty cans are mounted adjacent to lateral feed-in points in respective rows running at right angles to the direction of expulsion of the full cans. This requires a great deal of space. Moreover, in order to replace the cans, the heads must be stopped, because the replacement of a full can by an empty can takes a relatively long time due to the different directions of movement of the full and empty cans, and a larger gap exists between the full can which is led away and the empty can which is fed in. These disadvantages can be avoided with another known arrangement in which the cans are moved through the frame parallel to the working direction; but this arrangement has the drawback that the control and drive arrangement of the drawing frame can only be accommodated laterally beside the paths of movement of the cans, and hence the working area required is again very large.

An object of the invention is to provide a drawing frame, which requires a reduced working area and in which full cans can be replaced with empty cans without the draw heads being stopped.

The invention consists in a drawing frame including a double draw head, having devices for filling cans at two filling stations which are associated with respective draw heads, means for automatically replacing filled cans at the filling stations with empty cans and control and drive apparatus for the frame, all being arranged in a machine frame, the automatic replacement means being arranged to move, by rectilinear movement in the opposite direction to the working direction of the draw heads, the filled cans from the filling stations to removal station from which they can be expelled laterally from the machine frame and, simultaneously, to move the empty cans into the filling stations in the same rectilinear direction and the control and drive arrangement being disposed in line with the filling and removal stations whereby the ground plan or working area of the machine frame is at least roughly rectangular in shape.

The means for replacing the cans can preferably comprise a slide which can be moved to and fro in the working direction along a line running between the two filling stations, and on which are mounted on the transport arms for pivotal movement about vertical axes, the transport arms being spring-loaded against a limit position in which they form an acute angle with the direction of feed of the cans, and being movable against the slide against the action of the spring-loading. The operation of the slide to interchange the cans can be controlled by a meter counter after each of the cans has been filled. Furthermore, after replacement of the cans, two expulsion arms can be actuated automatically, to push the filled cans sideways out of the removal stations into which they have been moved, and hence out of the machine frame.

Figure 2:
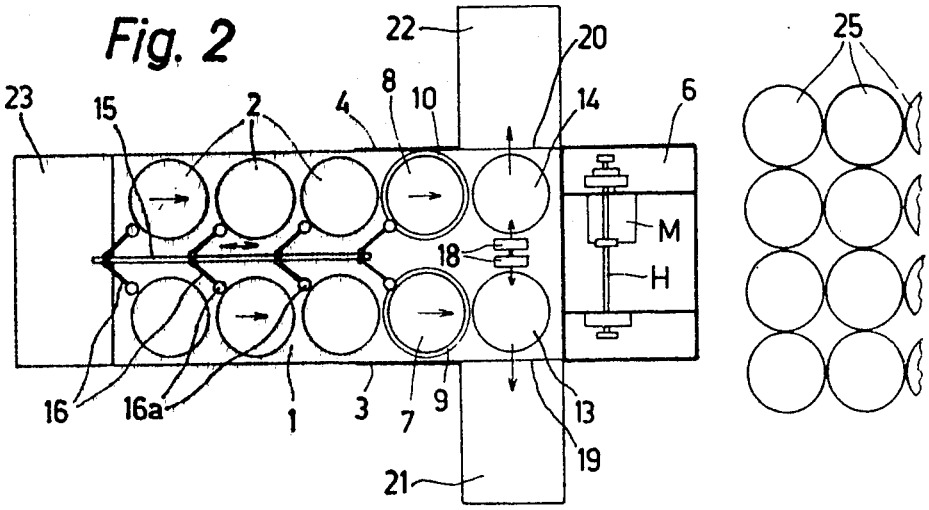

The invention may be performed in various ways and one specific embodiment will now be described, by way of example, with reference to the accompanying drawings, in which, FIG. 1 is a side view of a drawing frame; and FIG. 2 is a horizontal section along the line II—II in FIG. 1.

The machine frame of the drawing frame, which is illustrated, has a base 1, on which empty cans 2 are fed in in two parallel rows, and a housing with side walls 3 and 4, an upper housing part 5 and a rear housing part 6. Two cans 7 and 8 are illustrated at filling stations where they stand on can plates 9 and 10 in the base 1. A double draw head frame 11 is located in the upper part 5 of the housing. The draw head frame 11 is indicated diagrammatically in FIG. 1 and has devices 12 for filling the cans 7 and 8 which are at the filling stations.

When the cans 7 and 8 have been filled, they are automatically replaced by empty cans 2. The empty cans are moved rectilinearly into the filling stations counter to the working direction of the draw heads 11, and simultaneously the filled cans 7 and 8 are moved, in the same direction, into removal stations which are adjacent to the filling stations. Two cans 13 and 14 are indicated at these removal stations. It will be seen that the removal stations are situated between the filling stations (7 and 8) and the rear part 6 of the housing.

The cans 2 and 8 are moved by means of a slide 15, which can be moved backwards and forwards parallel to the working direction of the draw heads 11, along a straight line which runs between the two rows of empty cans 2 and between the filling stations 7, 8 (as indicated by a double arrow in FIG. 2). Transport arms 16 are mounted on the slide 15 so as to be swingable about vertical axes. The transport arms 16 are spring-loaded into their limit positions illustrated, in which they project from the slide 15 and form acute angles with the direction of feed of the cans. In these limit positions the transport arms 16 can act on the cans 2, and 7 and 8 by means of rollers **16*a* at their free ends, and move the cans in the described manner when the slide 15 is moved to the right in FIG. 2. The cans 2, and 7 and 8 are guided at their outsides by unillustrated guides, which are located on the insides of the side walls 3 and 4 and in continuations of the walls towards the left in FIG. 2. When the slide 15 is moved back to the left in FIG. 2, the transport arms 16 are moved against the slide 15** and thus slip past the cans, against the action of the spring-loading.

The slide 15 is driven, to and fro, by pneumatic means which are not illustrated. These are automatically switched on by a meter counter each time the can 7 and 8 are filled.

Since during replacement of the filled cans 7 and 8 by empty cans 2, the filled cans and the empty cans are moved rectilinearly in the same direction, the replacement can proceed very rapidly and with a minimal spacing between the filled and the empty cans, so that it is not necessary to interrupt the running of the draw heads 11.

After the interchange of the cans at the filling station, two expulsion arms 17 having rollers 18 at their free ends, are also actuated, once again automatically and by pneumatic means, to push the cans 13 and 14 from the removal stations out of the machine frame, at right angles to the working direction of the draw heads 11, through lateral openings 19 and 20, on respective sides of the machine. The cans are thus pushed out onto ramps 21 and 22, from which they can be removed and conveyed away.

Fresh empty cans are pushed onto the base 1 from the left in FIGS. 1 and 2 over a ramp 23.

The drive devices, control systems and suction devices of the machine are located in the rear part 6 of the housing. Of these, only an electric motor M, one main shaft H and two drive shafts A1 and A2 are indicated, diagrammatically, in FIGS. 1 and 2. An inlet table 24 of the drawing frame is mounted on the rear part 6. Cans 25 containing slubbings to be drawn are disposed beneath the table 24.

It will be appreciated that this arrangement of the slide 15, the filling stations (7 and 8), the removal stations (13 and 14), the lateral expulsion openings 19 and 20, and of the rear part 6 of the housing with the control, drive and suction devices produces a working area or ground plan which is essentially rectangular and which is utilised to the full. It will be appreciated that the ground plan or working area contains the spaces for the empty cans 2, the filling stations (7 and 8), the removal stations (13 and 14) and the control and drive device in the rear part 6 of the housing. The space requirement for the frame is therefore small in a desirable way; only sufficient space for a filled cans 13 or 14 respectively to be pushed out of the machine frame and then conveyed away is required on both sides beside the frame.

We claim:

1. A drawing frame comprising: a machine frame defining two can filling stations, two can removal stations with lateral outlets and a location for empty cans; a double draw head having devices for filling cans at the two filling station, each filling station being associated with a respective draw head; means for automatically replacing filled cans at the filling station with empty cans by rectilinear movement in the opposite direction to the working direction of the draw heads and for simultaneously, in the same rectinlear direction, moving the filled cans from the filling stations the the removal stations from which they can be expelled laterally from the machine frame; and control and drive apparatus for the drawing frame, the draw head, the can replacing means and the control and drive apparatus being disposed in the machine frame with the control and drive apparatus in line with the filling and removal stations whereby the grand plan of the machine is at least roughly rectangular in shape.

2. A drawing frames as claimed in claim 1, wherein the ground plan comprises in succession spaces for empty cans to be fed in, the filling stations, the removal stations and the control and drive apparatus.

3. A drawing as claimed in claim 2, wherein the means for replacing the cans comprises a slide which can be moved to and fro along a line running between the two filling stations and on which are mounted transport arms for movement between a first position in which they project laterally from the slide and a second position in which they are withdrawn.

4. A drawing frame as claimed in claim 2, wherein each transport arm is pivotally mounted on the slide about a roughly vertical axis, is spring-loaded into the first position in which it forms an acute angle witht the line of movement of the slide, and can be moved into the second position, against the action of the spring-loading.

5. A drawing frame as claimed in claim 1, further comprising expulsion arms disposed between the removal stations for pushing filled cans generally laterally out of the removal stations.

6. A drawing frame as claimed claim 5, wherein the expulsion arms are operative in response to the completion of the can replacing cycle.

* * * * *